US005164693A

United States Patent [19]

Yokoyama et al.

[11] Patent Number: 5,164,693

[45] Date of Patent: * Nov. 17, 1992

[54] REMOTELY CONTROLLABLE CIRCUIT BREAKER WITH IMPROVED ARC DRIVE STRUCTURE

[75] Inventors: Youichi Yokoyama, Amagasaki; Hideya Kondo, Hirakata; Youichi Kunimoto, Osaka; Manabu Yano, Shijyonawate, all of Japan

[73] Assignee: Electric Power Research Institute, Inc., Palo Alto, Calif.

[ * ] Notice: The portion of the term of this patent subsequent to Oct. 17, 2007 has been disclaimed.

[21] Appl. No.: 295,312

[22] Filed: Jan. 9, 1989

[30] Foreign Application Priority Data

Jun. 9, 1988 [JP] Japan ..... 63-142557

[51] Int. Cl.[5] ..... H01H 75/00

[52] U.S. Cl. ..... 335/14; 335/20; 335/201

[58] Field of Search ..... 335/6, 14, 20, 201, 335/35, 172-176; 200/147 R, 144 R

[56] References Cited

U.S. PATENT DOCUMENTS

| | | | |
|---|---|---|---|
| Re. 32,882 | 3/1989 | Yokoyama et al. | 335/14 |
| 4,509,026 | 4/1985 | Matsushita | 335/85 |
| 4,598,263 | 8/1986 | Heyne et al. . | |
| 4,604,596 | 8/1986 | Yokoyama et al. | 335/14 |
| 4,604,599 | 8/1986 | Koehler | 335/234 X |
| 4,635,016 | 1/1987 | Guery et al. | 335/234 X |
| 4,682,132 | 7/1987 | Belbel et al. . | |
| 4,700,160 | 10/1987 | Belbel et al. . | |
| 4,730,175 | 3/1988 | Ichikawa et al. | 335/230 |

FOREIGN PATENT DOCUMENTS

| | | | |
|---|---|---|---|
| 0148305 | 8/1984 | Japan | 335/230 |
| 2167235 | 11/1984 | United Kingdom . | |

*Primary Examiner*—Lincoln Donovan
*Attorney, Agent, or Firm*—Laurence Coit

[57] ABSTRACT

A remotely controllable circuit breaker has an improved scheme for effecting rapid arc extinction as well as protecting the breaker contact from the resulting arc current. The breaker includes first and second movable contacts 11 and 12 which are held respectively on parallel extending first and second contact arms 31 and 32 and are driven individually by a switching mechanism 20 including a manual handle 22 with a contact trip capability and by a remotely controllable switch 60. An arc runner 115 is connected to be in the same electrical potential as the second contact arm 32 and extends in the contact separating direction for receiving the one end of the arc developed between the rapidly separating contacts 11 and 12 and guiding the arc toward an arc extinguishing chute 110 as the first contact 11 moves away from the second contact 12. The arc runner 115 is connected at its end opposite to the arc chute 110 to an arc drive member 116 which extends immediately behind the second contact arm 32 in parallel relation thereto. The repulsion force acts to urge the arc toward the arc chute 110 for rapid arc extinction. At this time, the arc current will bypass the second contact arm 32 for protecting it from the overcurrent.

7 Claims, 14 Drawing Sheets

REMOTELY CONTROLLABLE CIRCUIT BREAKER WITH IMPROVED ARC DRIVE STRUCTURE

BACKGROUND OF THE INVENTION

1. Field of the Invention

The present invention is directed to a remotely controllable circuit breaker which responds to a remote control signal for closing and opening a breaker contact, and more particularly to such a remotely controllable circuit breaker with an improved arc drive structure for rapid arc extinction.

2. Description of the Prior Art

Remotely controllable circuit breakers are well known in the art to have a set of first and second movable contacts respectively driven by a manual switching mechanism with a contact tripping action and by a remote control signal responsive switch. Unfortunately, the prior circuit breakers with remote control capability have been found to be unsatisfactory for the protection against an arc formed between the separating contacts as well as the resulting arc current. For example, U.S. Pat. No. 4,598,263 discloses to mount an arc chute composed of arc shearing plates along the contact separation path in order to expedite arc extinction by drawing the arc into the arc chute due to electromagnetic repulsion forces developed between first and second contact arms extending parallel to each other and flowing the current therethrough upon the occurrence of the arc. Although this arrangement appears to be effective for rapid arc extinction, it suffers from a problem that the arc current or overcurrent will continue to flow through the second contact arm and the second contact held thereon and may cause undesired contact welding or contact defection thereat. Another prior remotely controllable circuit breaker with arc extinction scheme is disclosed in U.S. Pat. No. 4,604,596. This patent utilizes a bypass conductor which, upon the occurrence of the arc, acts to bypass the overcurrent around the second movable contact arm to protect the second contact from being exposed to such over-current. However, in this patent, there is no scheme for magnetically driving the arc for rapid arc extinction by acting on the arc the electromagnetic repulsion forces. The lack of this magnetic arc drive is due to the difficulty in placing within the structure of the breaker an additional conductor in parallel relation to the first contact arm and in spaced relation thereto close enough to produce the electromagnetic forces of sufficient strength for the arc drive.

SUMMARY OF THE INVENTION

The present invention eliminates the above insufficiency and provides an improved arc protective scheme for the remotely controllable circuit breaker. The circuit breaker in accordance with the present invention comprises a breaker housing having therein a breaker contact composed of first and second movable contacts. The first contact is carried on a first contact arm which is operatively connected to a switching mechanism to be driven thereby to move between an OFF position and an ON position. The second contact is carried at one end of a second contact arm which extends along the first contact arm in a generally parallel relation thereto. The switching mechanism comprises a manual handle for manually moving the first contact arm between the OFF and ON positions and a trip means which moves the first contact arm forcibly to the OFF position upon the occurrence of an over-current condition. The second contact arm is connected to a remotely controllable switch which responds to a remote control signal for moving the second contact arm between an operative position where the second contact is permitted to come into electrical contact with the first contact in the ON position and an inoperative position where the second contact is kept away from the first contact to be inhibited from contacting with the first contact. The breaker includes an arc extinguishing chute disposed on the opposite side of the first contact arm from the second contact arm for extinguishing an arc initially developed between the rapidly separating first and second contacts. An arc runner extends generally along the contact separation path towards the arc extinguishing chute and is electrically coupled to the second contact arm to have the same electrical potential as the second contact arm such that the one end of arc developed between the first and second contacts is transferred to the arc runner from the second contact upon initial contact separation and that the arc is guided along the arc runner towards the arc extinguishing chute with the one end thereof anchored on the arc runner as the first contact arm moves to its OFF position.

Associated with the arc runner is an arc drive member which extends immediately behind the second contact arm in a generally parallel relation to the first contact arm with the one end of the arc runner electrically connected to the arc runner behind the second contact arm. The other end of the arc drive member is electrically connected to the end of the second contact arm opposite to the second contact such that the arc runner and the arc drive member are in the same potential as the second contact arm to thereby bypass the arc current around the second contact arm. Upon the occurrence of the arc, the arc drive member is cooperative with the first contact arm to flow the arc current through the arc drive member in the opposite direction to that flowing through the first contact arm and the arcing path, thereby producing electromagnetic repulsion forces which are exerted between such parallel conductors and act on the arc to urge or drive it towards the arc chute. With the combination of the arc runner and the arc drive member, the arc is rapidly driven towards the arc chute by the electromagnetic repulsion force and at the same time the resulting arc current will bypass the second contact arm for protecting the same from the arc current which would otherwise cause contact welding or the like contact defection.

Accordingly, it is a primary object of the present invention to provide a remotely controllable circuit breaker which is capable of effecting rapid arc extinction as well as protecting the second contact from the arc current.

In the above breaker structure, since the second contact arm is free from the arc current, its material can be selected without regard to heat or arc resistivity and solely on electrical conductivity, while the arc runner and the arc drive member can have its material selected to have enough heat resistivity plus suitable current limiting effects. Thus, the breaker can have an improved electrical conductive performance in the normal condition and can also have a current limiting effect by the arc runner and the arc drive member themselves in addition to the arc stretching action in the overcurrent condition, which is therefore another object of the present invention.

In a preferred embodiment, the remotely controllable switch comprises an electromagnet which is disposed within the housing in side-by-side relation to the switching mechanism with the first and second contact arms interposed therebetween. The arc drive member extends along a partition wall which serves to electrically isolate the drive member from the electromagnet and serves as a barrier for blowing back an arc gas towards the arc chute. With this arrangement, the arc drive member can be disposed in closely adjacent relation to the remotely controllable electromagnet while assuring electrical insulation therebetween, which in turn gives rise to a compact arrangement of the circuit breaker particularly with respect to its width dimension along which the switch mechanism, first and second contact arms and the electromagnet are arranged. The second contact arm is formed at its end adjacent the second contact with a pilot extension which projects toward the arc runner to leave therebetween a small arc transferring gap for readily transferring the one end of the arc to the arc runner at the initiation of the arcing, which is therefore a further object of the present invention.

In a modified version of the present invention, the connection between the arc runner and the arc drive member is bent towards the end of the second contact arm carrying the second contact so as to leave between the bent portion and the second contact arm a small arc transferring gap for enhancing the arc transfer. The connection between the arc runner and the arc drive member includes a vertical segment which extends in a generally parallel relation to the first contact arm and within substantially the same plane of the second contact arm so that it is closer to the first contact arm than the substantial portion of the arc drive member. Consequently, arc extending between the first contact arm and the arc runner can be subjected to an increased electromagnetic repulsion force from the vertical segment to be thereby driven fast towards the arc chute.

It is therefore a still further object of the present invention to provide a circuit breaker in which the arc driving member can be positioned closely to the first contact arm to effect an improved or fast arc drive performance.

In the present invention, there are disclosed still further advantageous features with regard to an effective scheme for exhausting a volume of ionized gases developed by the arc reacting with its environments.

These and still other objects and advantages will become apparent from the following description of the preferred embodiment of the present invention when taken in conjunction with the attached drawings.

DETAILED DESCRIPTION OF THE PREFERRED EMBODIMENT

Figure 1:
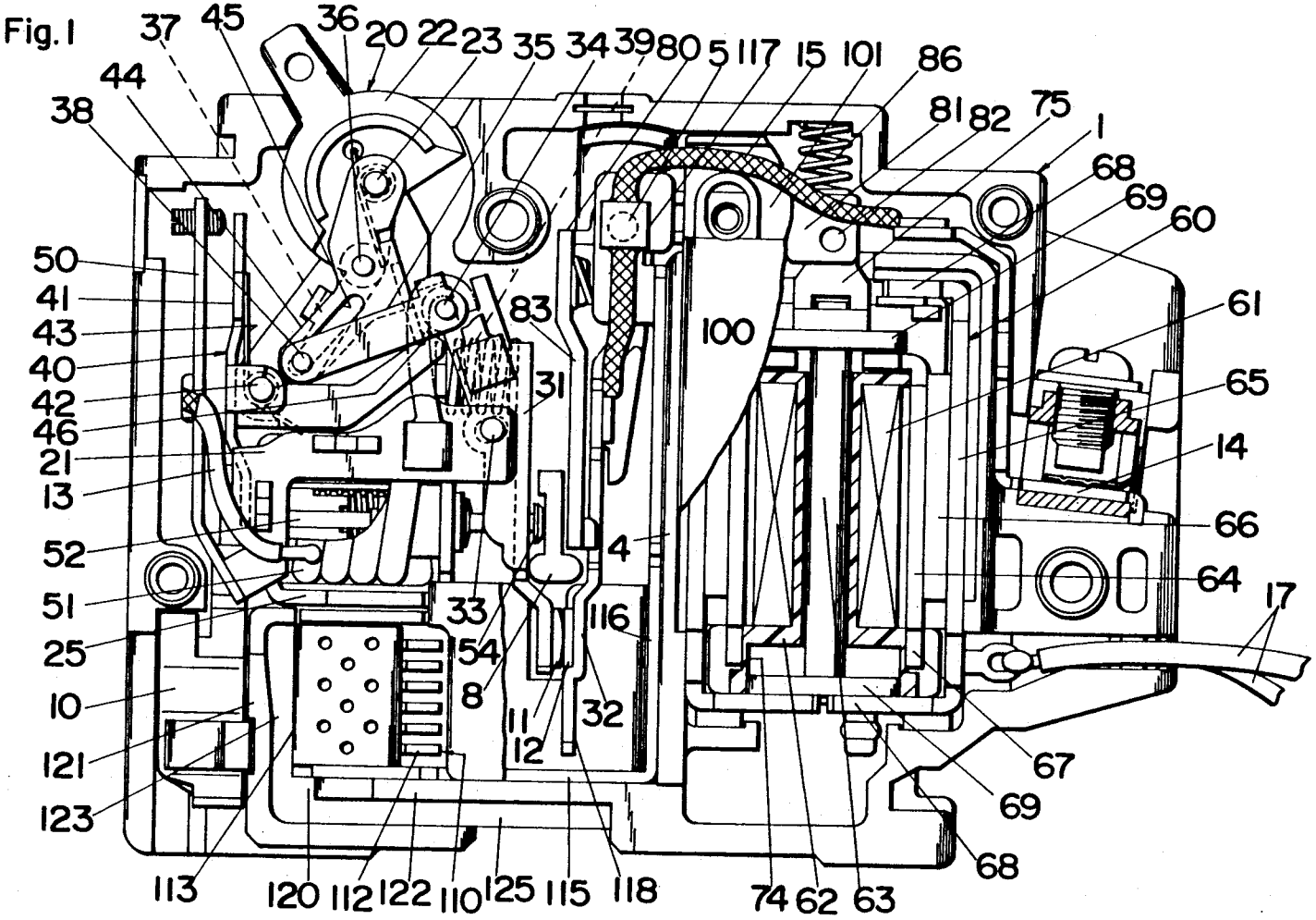
FIG. 1 is a vertical section of a remotely controllable circuit breaker in accordance with a preferred embodiment of the present invention.
Figure 2:
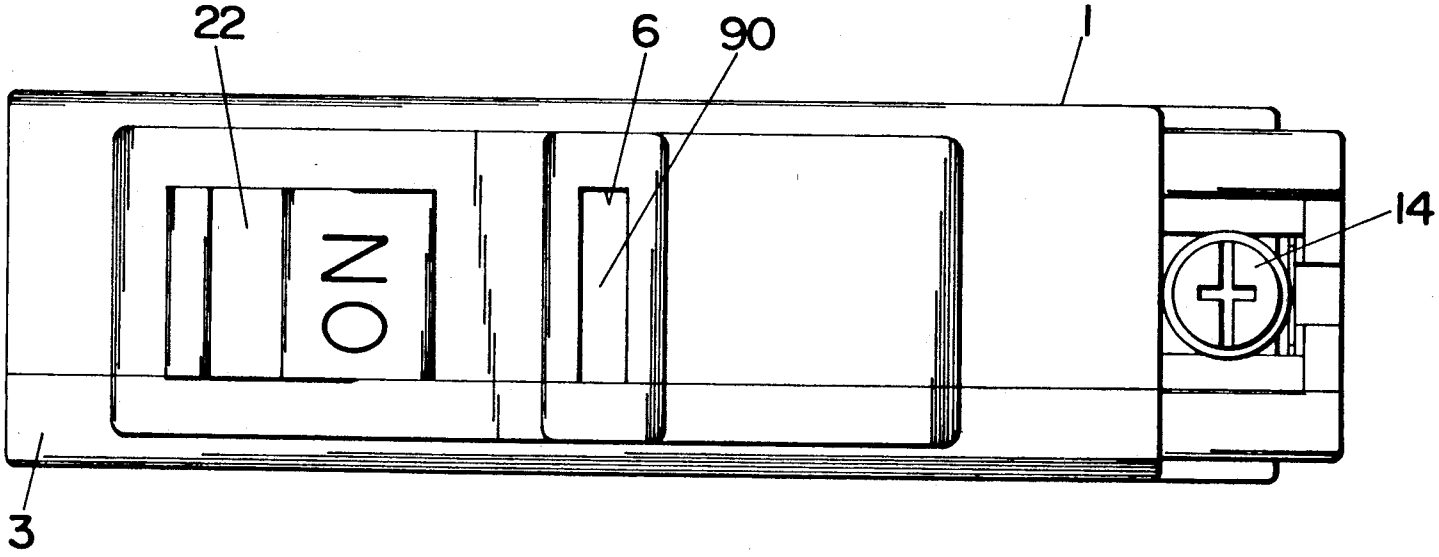
FIG. 2 is a top view of the breaker.
Figure 3:
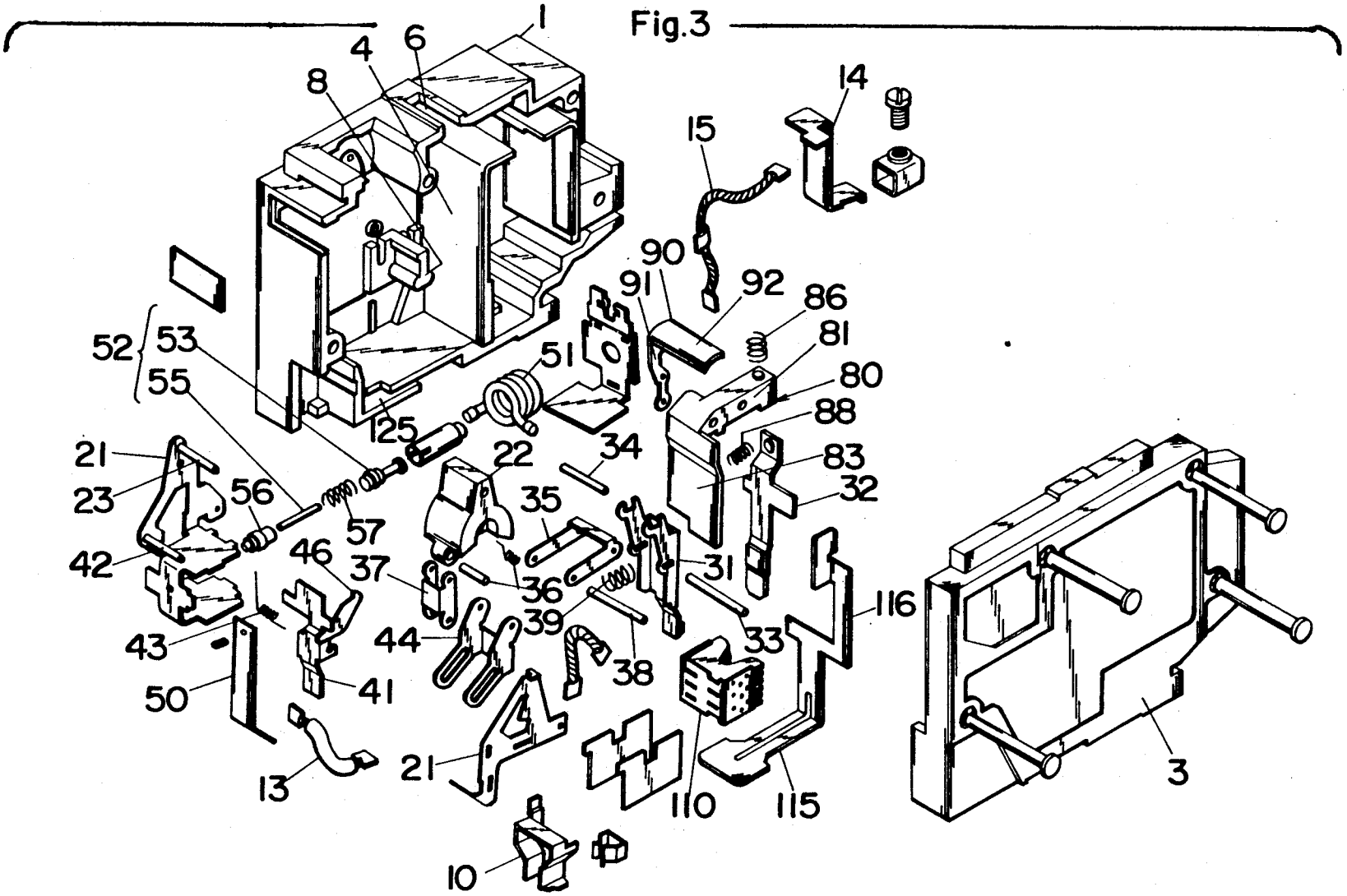
FIG. 3 is an exploded perspective view of the breaker.

Referring to FIGS. 1 to 3, a remotely controllable circuit breaker according to a preferred embodiment of the present invention is shown to comprise a housing 1 of electrically insulative material in which a manually operable switching mechanism 20 is provided to open and close a single set of first and second breaker contacts 11 and 12 by manipulation of a manual handle 22.

The housing 1 includes a side cover 3 and is separated by a partition 4 into two compartments, one for receiving the switching mechanism 20 and the other for receiving a remotely controllable electromagnet switch 60 which is responsive to a remote control signal fed from a location remote from the breaker for opening the contacts, such remote control responsive contact opening operation overriding the manual switching operation to forcibly open the contacts 11 and 12.

The switching mechanism 20 comprises a frame 21 pivotally supporting the manual handle 22 about a handle pivot 23 at the upper end and a first movable contact arm 31 about a pivot pin 33 at the right end of the frame 21. The first movable contact arm 31 carries at its lower end the first contact 11 and is electrically connected to a line terminal 10 at the left end of the housing 1 by way of a braid 13, the frame 21, a bimetallic strip 50, and a magnetic coil 51. The second contact 12 is carried on the lower end of a second movable contact arm 32 extending vertically in generally parallel relation to the first contact arm 31 and electrically connected to a load terminal 14 at the right end of the housing 1 by Way of a braid 15. The first contact arm 31 is pivoted at the middle of its length by the pivot pin 33 and is connected at its upper end to the handle 22 by way of pivot links 35 and 37 so that it is movable between an OFF position and an ON position as the handle 22 is manipulated to pivot about the handle pivot 23. The first contact arm 31 has its upper end connected to the pivot link 35 by a pivot pin 34. In FIG. 1, the first contact arm 31 is shown in its ON position where it has the first contact 11 in contact with the second contact 21 and is held in this position against the bias of a compression spring 39 by the action of a toggle linkage formed by pivot connections at pins 23, 36, and 38. The linkage connecting the handle 22 and the first contact arm 31 in the present embodiment assures the contact closing in a delayed-make fashion and the contact opening in a quick-break fashion.

Included in the switching mechanism 20 is a trip mechanism 40 which opens the contacts 11 and 12 upon occurrence of predetermined overload current conditions detected by the bimetallic strip 50 or by the magnetic coil 51 which is connected in series between the first contact arm 31 and the line terminal 10. The trip mechanism 40 includes a latch lever 41 pivotally supported on the frame 21 and a cradle link 44 pivoted a: its upper end to the handle 22 by the handle pivot 23. The cradle link 44 has a slit 45 for guiding therealong the pin 38 connecting the pivot links 35 and 37, and is therefore urged by the spring 39 in a clockwise direction in the figure about the handle pivot 23. The cradle link 44 is kept latched at 46 by the end of the horizontal arm of the latch lever 41 and is held in the position against the bias of the spring 39. The latch lever 41 is pivotable about a pin 42 and is urged by a torsion spring 43 in the counterclockwise direction as viewed in the figures. The vertical arm of the latch lever 41 extends along the bimetallic strip 50 in abuttable relation thereto.

Figure 11:
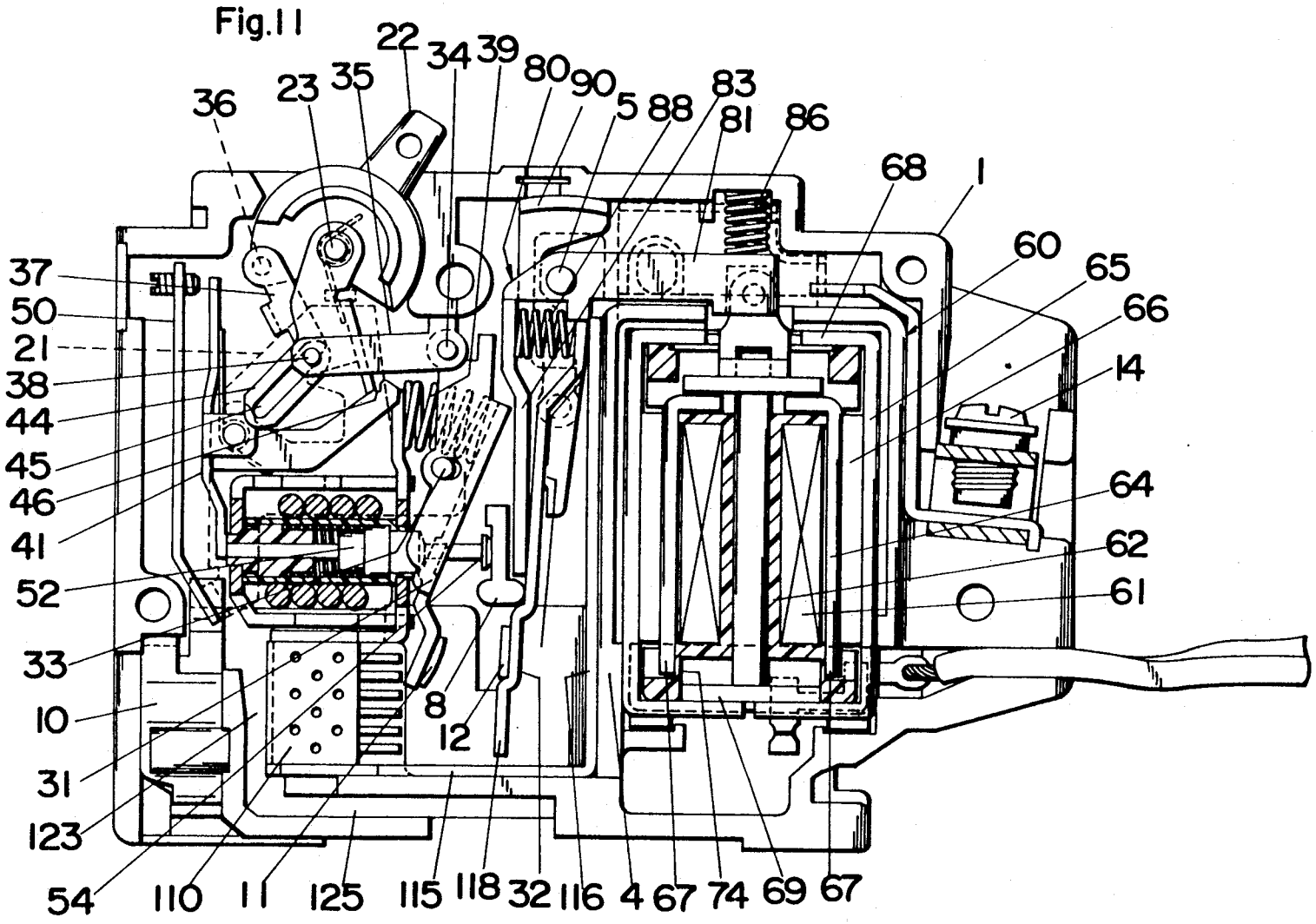
Figure 12:
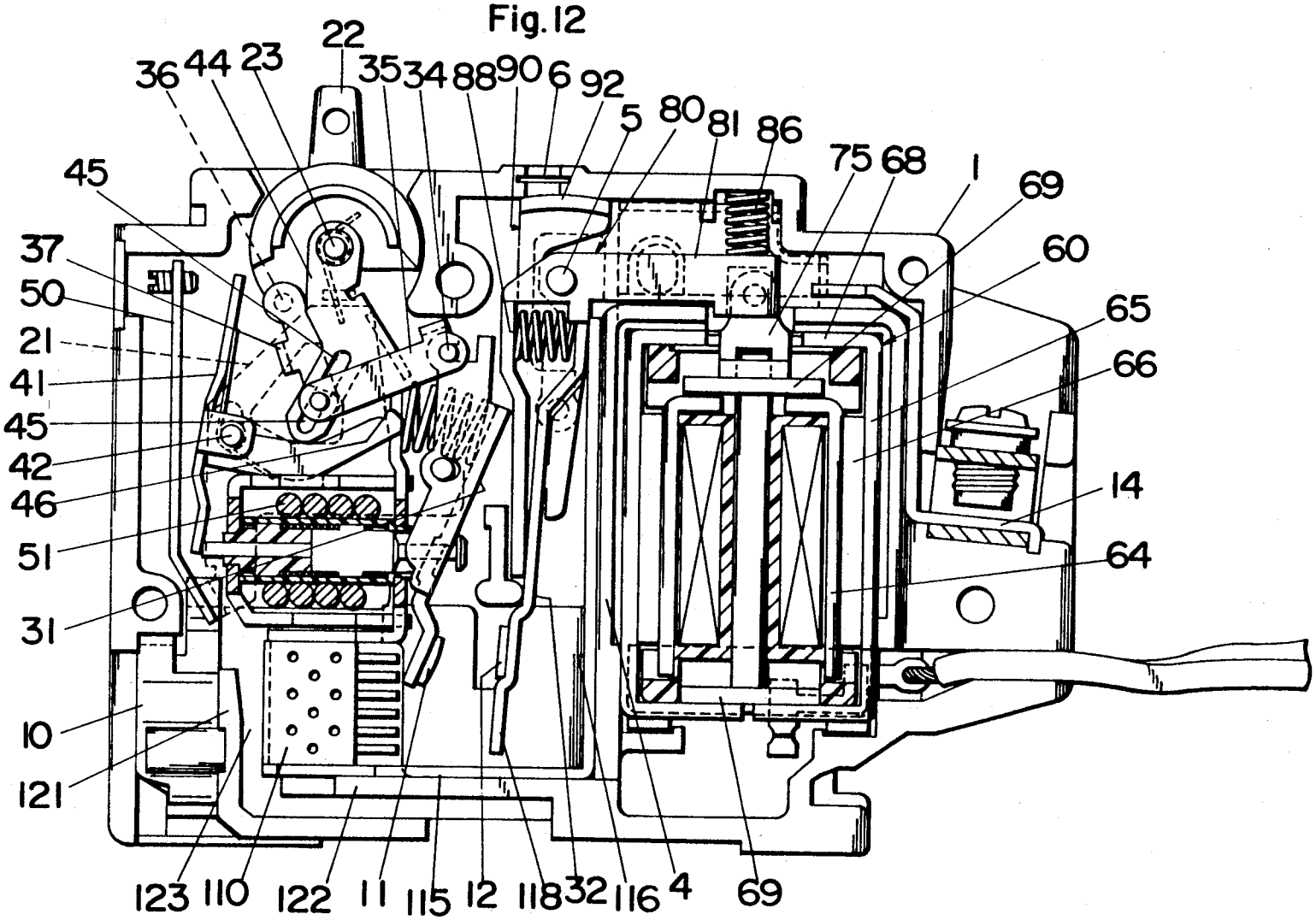
Figure 13:
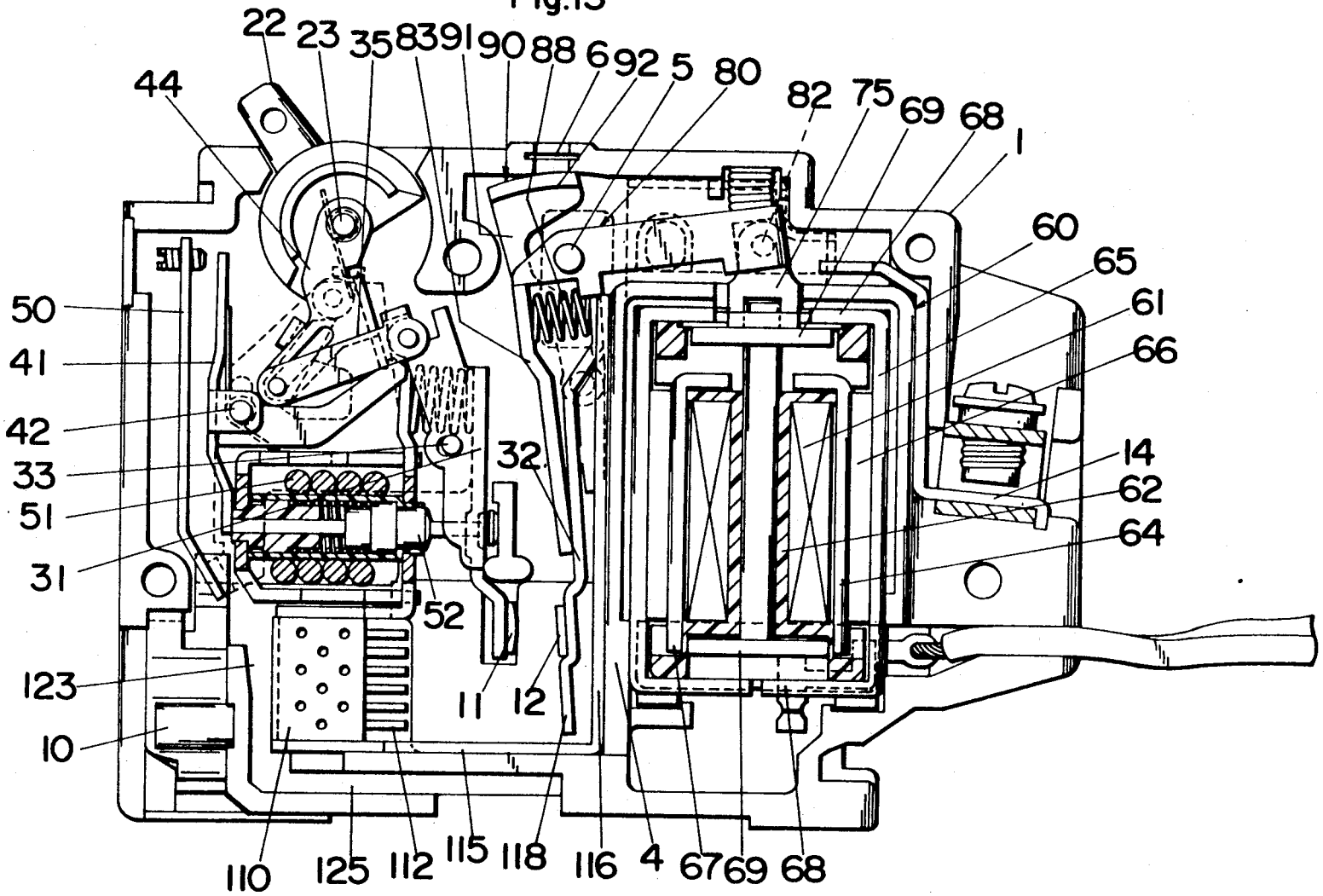

When the bimetallic strip 50 sees an overcurrent, it is deflected toward the vertical arm of the latch lever 41 to force the same to pivot in the clockwise direction, thus unlatching the cradle link 44. Upon this occurrence, the cradle link 44 is urged by the spring 39 to pivot in the counterclockwise direction to thereby pull the pin 38 retained in the slit 45 to the right, as seen in FIG. 11, thus forcing the first contact arm 31 to pivot about the pin 33 from the ON position to the OFF position.

The magnetic coil 51 includes a release rod 52 which extends therethrough to be axially movable. As shown in FIG. 3, the release rod 42 comprises a movable core 53 biased by a spring 57 away from a fixed core 56 at one end of the coil 51 and has at its one end a catch 54 for engagement with the first contact arm 31. The release rod 52 also includes a drive pin 55 extending through a fixed core 56 to be abuttable against the lower end of the vertical arm of the latch lever 41. Upon the occurrence of an extreme overcurrent flowing through the circuit, the magnetic coil 51 is magnetized to thereby attract the movable core 53 towards the fixed core 56. At this time, the first contact arm 31 is pulled by the catch 54 of the movable core 53 to be forcibly disengaged from the second contact arm 32 for immediate contact separation. Also at the same time, the drive pin 55 is pushed by the movable core 53 to strike the lower end of latch lever 41, thus pivoting the latch lever 41 to unlatch the cradle link 44, after which the same tripping action is performed as initiated by the bimetallic strip 50 to keep the contacts opened until they are reset by the manipulation of the handle 22. In this manner, the contact separation effected by directly pulling the first contact arm 31 always precedes the contact separation by the trip action and therefore assures an immediate contact separation for protecting the load circuit from an extreme overcurrent condition. It is noted at this point that the first contact arm 31 is connected to the release rod 52 at a point opposite of the pivot axis 33 from the upper effort point 34 receiving the forces from the handle 22 as well as from the trip mechanism 40. With this structure, the release rod 52 can give an enough contact separation travel distance equivalent to that effected by the handle movement and the tripping action, yet allowing the magnetic coil 51 to be spaced from the effort point 35 along the length of the first contact arm 31 to such an extent as to accommodate within that length the parts or the portion of the switching mechanism 20. Thus, the switching mechanism 20 including the magnetic coil 51 can be made in a compact arrangement while retaining the immediate and reliable contact separation by the magnetic coil 51.

The second contact arm 32 is connected through an L-shaped actuator 80 to the remotely controllable electromagnet switch 60 to be driven thereby to move between an operative position where the second contact 12 is engageable With the first contact 11 and an inoperative or disable position where the second contact 12 is inhibited from engaging with the first contact 11 irrespective of the condition of the manually switching mechanism 20. The electromagnet switch 60 is activated in response to a remote control signal fed from a remote station through lines 17. In the present embodiment, the electromagnet switch 60 is a polarized electromagnet of monostable type which keeps the second contact 12 in the operative position of FIG. 1 in the deenergized condition and moves the second contact 12, upon being energized, to the inoperative position to disable a load connected to the breaker.

Figure 4:
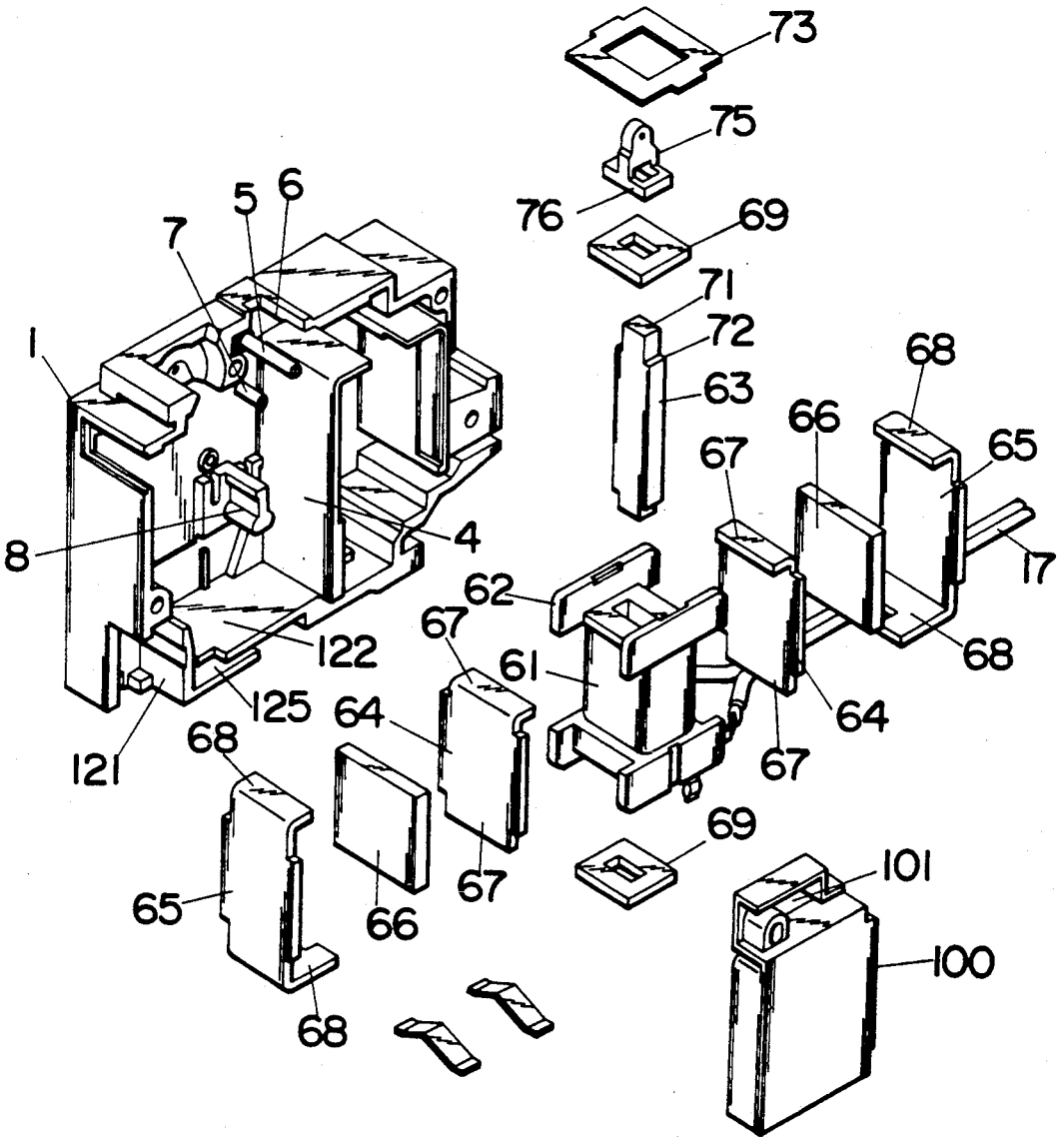
FIG. 4 is an exploded perspective view of an electromagnet employed in the breaker.

The electromagnet switch 60 comprises, as best shown in FIGS. 1 and 4, an excitation coil 61 wound around a bobbin 62, an axially movable plunger core 63 extending through the bobbin 62, paired inner yokes 64, paired outer yokes 65, and permanent magnets 66 each interposed between the inner and outer yokes 64 and 65 to magnetize them in the opposite polarity. The inner and outer yokes 64 and 65 define inner and outer pole ends 67 and 68 respectively at the upper and lower ends thereof, and extend outwardly of the excitation coil 61 in parallel with the axis thereof so as to form magnetic gaps between the adjacent inner and outer pole ends 67 and 68. Provided respectively at the upper and lower ends of the plunger core 63 are pole plates 69 each located between the magnetic gap. The outer pole ends 68 at the upper and lower ends of the outer yoke 65 are bent at a right angle to form flanged pole ends to be abuttable with the corresponding one of the upper and lower pole plates 69. The inner pole end 67 is bent at a right angle only at the upper end of the inner yoke 64 to form a flanged pole end for abutment with the upper pole plate 69, while the inner pole end 67 at the lower end is spaced laterally outwardly from the pole plate 69 to form therebetween a constant air gap so that the plunger core 63 is stable at the position of FIG. 1 in which the upper and lower pole plates 69 are respectively in contact with the upper inner pole ends 67 and the lower outer pole ends 68 to complete the circuit of the magnetic flux emanating from the permanent magnets 66.

When the excitation coil 61 is energized by the control signal of a given polarity, the plunger core 63 is magnetized in the direction opposing the magnetic flux by the permanent magnets 66 to be thereby driven to move axially upwardly. The upper end of the plunger core 63 is connected to the L-shaped actuator so carrying the second contact arm 32 so that upon energization of the electromagnet 60 the upward movement of the plunger core 63 is transmitted to the second contact arm 32 to move the same into the inoperative position for opening the breaker circuit. In this position, the pole plate 69 at the upper end of the plunger core 63 abuts through a residual plate 73 against the flanged outer pole ends 68 at the upper ends of the outer yokes 65. Upon deenergization of the electromagnet 60, the plunger core 63 moves downwardly back to its stable position by the help of a return spring 86 acting on the connection between the plunger core 63 and the actuator 80, bringing the second contact arm 32 back into the operative position. The electromagnet switch 60 thus constructed is received within a cavity surrounded by the partition 4 with a joint 75 at the upper end of the plunger core 63 extending upwardly through the partition 4.

Figure 6:
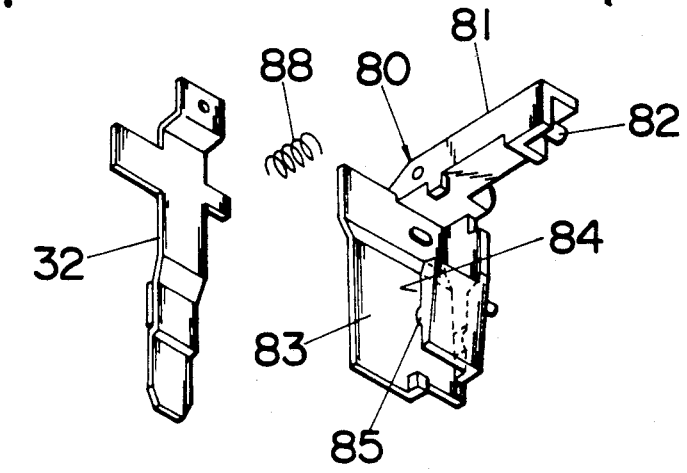
FIG. 6 is an exploded perspective view of an L-shaped actuator and a second contact arm employed in the breaker.

The L-shaped actuator 80 is made of electrically insulative material with a horizontal member 81 and a vertical member 83, and is mounted in the housing 1 outward)y of the partition 4 with its connection between the members 81 and 83 pivotally Supported about a pivot post 5 integral with the housing 1. The horizontal member 81 extends over the width dimension of the electromagnet switch 60 and is connected at its free end by an integral pin 82 to the joint 75 at the upper end of the plunger core 63. The spring 86 biasing the plunger core 63 to its stable position is held between the end of the horizontal member 81 and the upper wall of the housing 1. The vertical member 83 likewise extends over the length dimension of the electromagnet switch 60 and carries the second contact arm 32 for movement thereof between the operative and inoperative positions. As shown in FIG. 6, the upper half portion of the second contact arm 32 is held within a slit 84 of the vertical member 83 with its lengthwise center abutting against a fulcrum projection 85 in the slit 84 and with a compression spring 88 interposed between the upper end of the second contact arm 32 and the vertical member 83. Thus, the second contact arm 32 is allowed to pivot about the fulcrum projection 85 to a limited extent relative to the vertical member 83 against the bias of the spring 88. This is contemplated to effect a rapid contact separation on the side of the second contact arm 32 in case of an extreme overcurrent flowing through the circuit. That is, the second contact arm 32 will be instantly driven to move away from the first contact arm 31 while the actuator 80 is kept stationary due to the electromagnetic repulsion forces acting between the first and second contact arms 31 and 32 extending in parallel relation to each other and seeing such extreme overcurrent, enabling prompt contact separation in advance of the contact separation by the tripping mechanism 40 for safely protecting the load. A stop 8 projects integrally from the housing 1 for abutment respectively with the first and second contact arms 31 and 32 upwardly of the first and second contacts 11 and 12.

Figure 7:
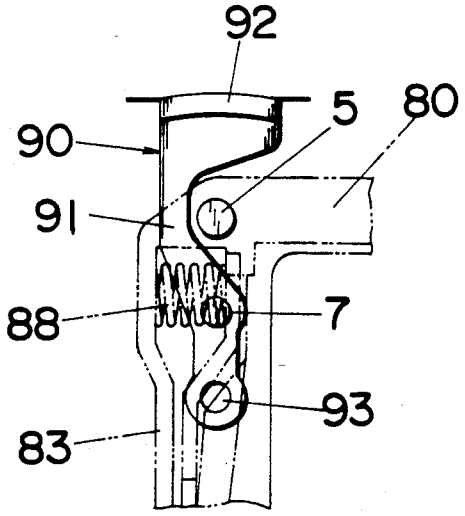
FIG. 7 is a partial view showing the mounting of an operation indicator in relation to the L-shaped actuator in the breaker.

An indicator 90 is mounted adjacent the actuator 80 to be pivotable together therewith between two angled positions indicative of the operative and inoperative positions of the second contact arm 32. The indicator 90 comprises a lever 91 extending in an overlying relation to the vertical member 83 of the actuator 80 and a display section 92 at the upper end of the lever 91. The display section 92 may be provided with markings for the inoperative and operative positions of the second contact arm 32 which can be viewed through a window 6 in the upper wall of the housing 1. As shown in FIG. 7, the lever 91 is pivoted at a pivot pin 7 spaced downwardly from the pivot axis 5 for the actuator 80 and is connected at its lower end 93 to the vertical member 83 of the actuator 80 in order to obtain a greater lever ratio for obtaining a sufficient amount of angular displacement of the display section 92 which is required for the changeover of the marking to be viewed through the window 6.

Figure 5:
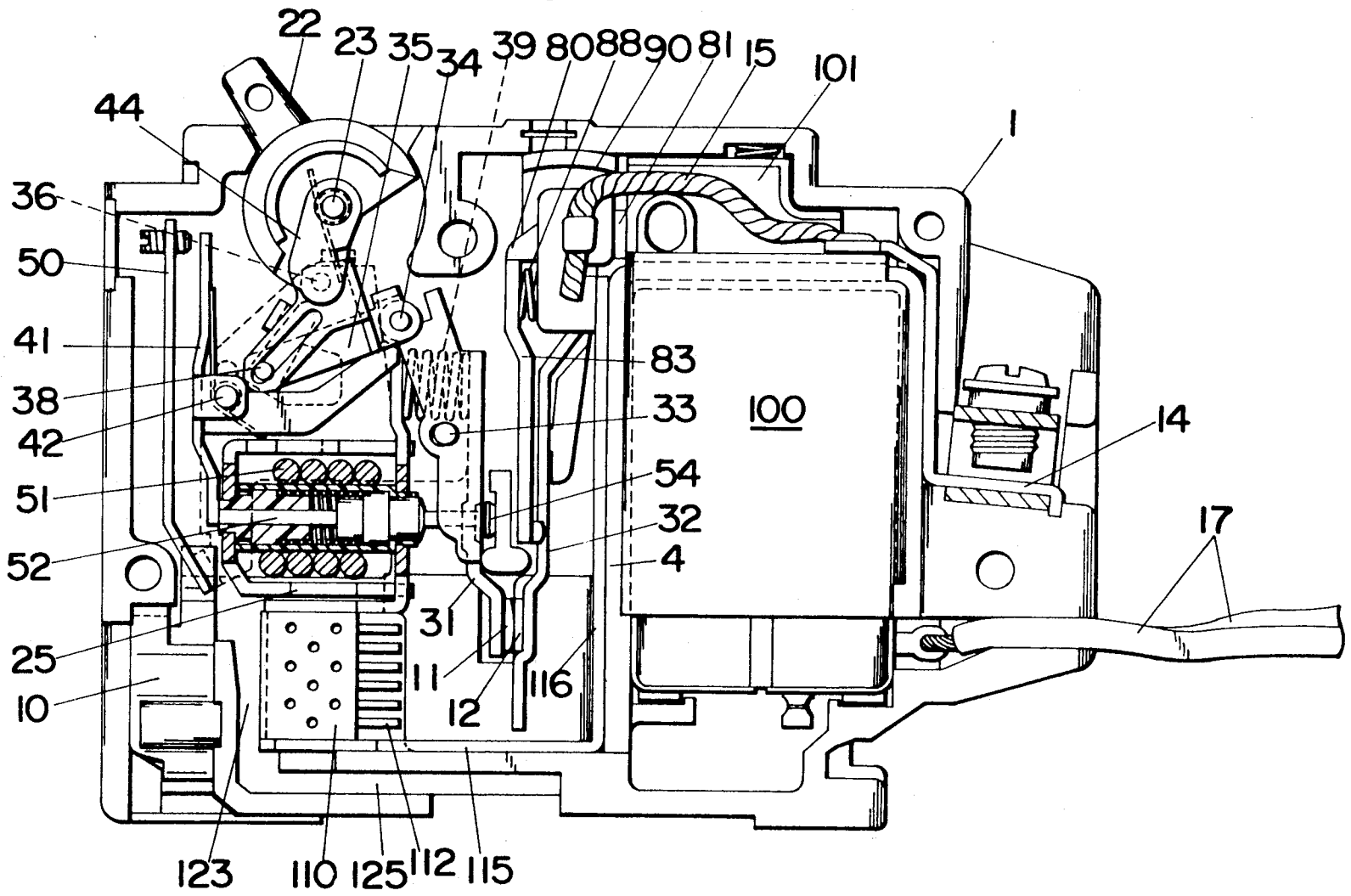
FIG. 5 is a vertical section of the breaker showing a protecting cover for the electromagnet.

As shown in FIGS. 4 and 5, a protective cover 100 of electrically and magnetically insulating material is provided to fit within the confines of the partition 4 over the electromagnet 60, completely insulating the electromagnet 60 from the adjacently disposed second contact arm 32 and the load terminal 14, and further from an arc drive member 116 extending along the Outer vertical surface of the partition 4 in parallel with the second contact arm 32. The details of the arc drive member 116 will be discussed hereinafter with regard to an arc extinction mechanism. Integrally extending upwardly from the protective cover 100 is a grooved flange 101 which extends beyond the partition 4 to be fitted within the upper wall of the housing 1 and the upper end wall of the partition 4 in an overlying relation to the horizontal member 81 of the L-shaped actuator 80. It is within this grooved flange 101 that the braid 15 interconnecting the second contact arm 32 and the load terminal 14 is received so that it is also completely insulated from the electromagnet 60.

Figure 9:
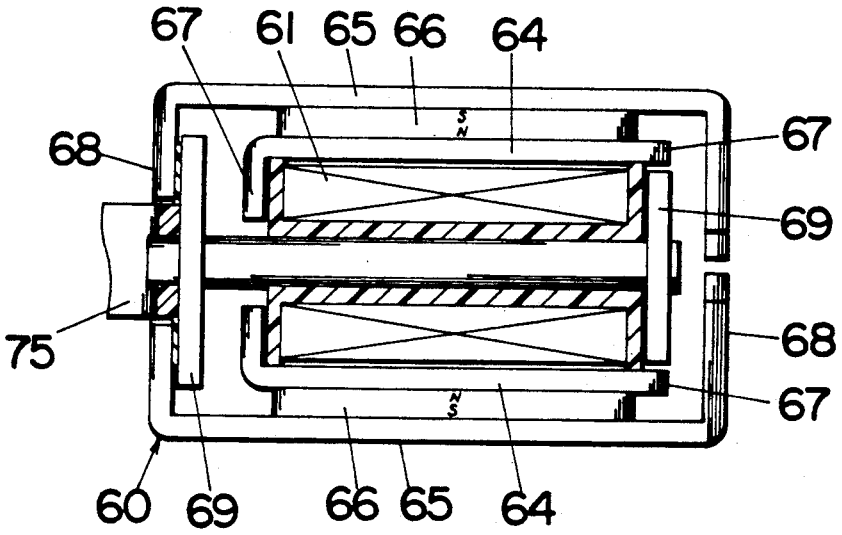
FIGS. 8 and 9 are explanatory views respectively showing the operation of the electromagnet.
Figure 8:
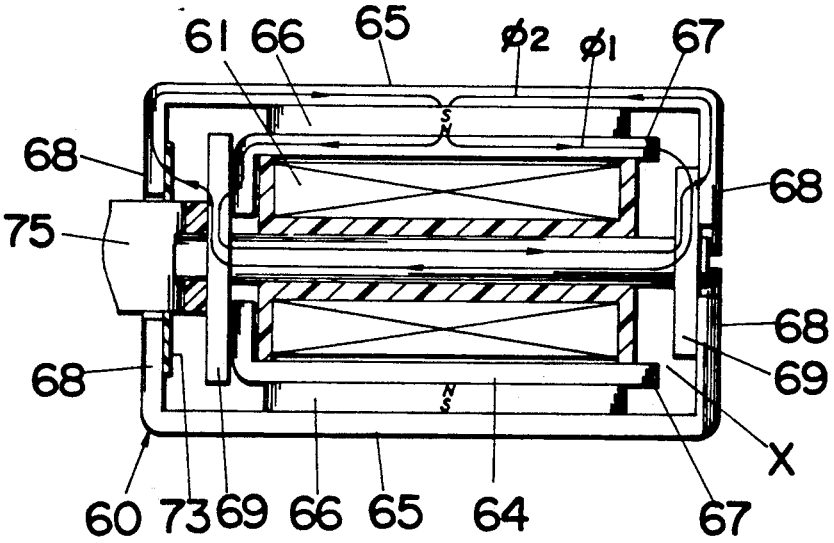
Figure 10:
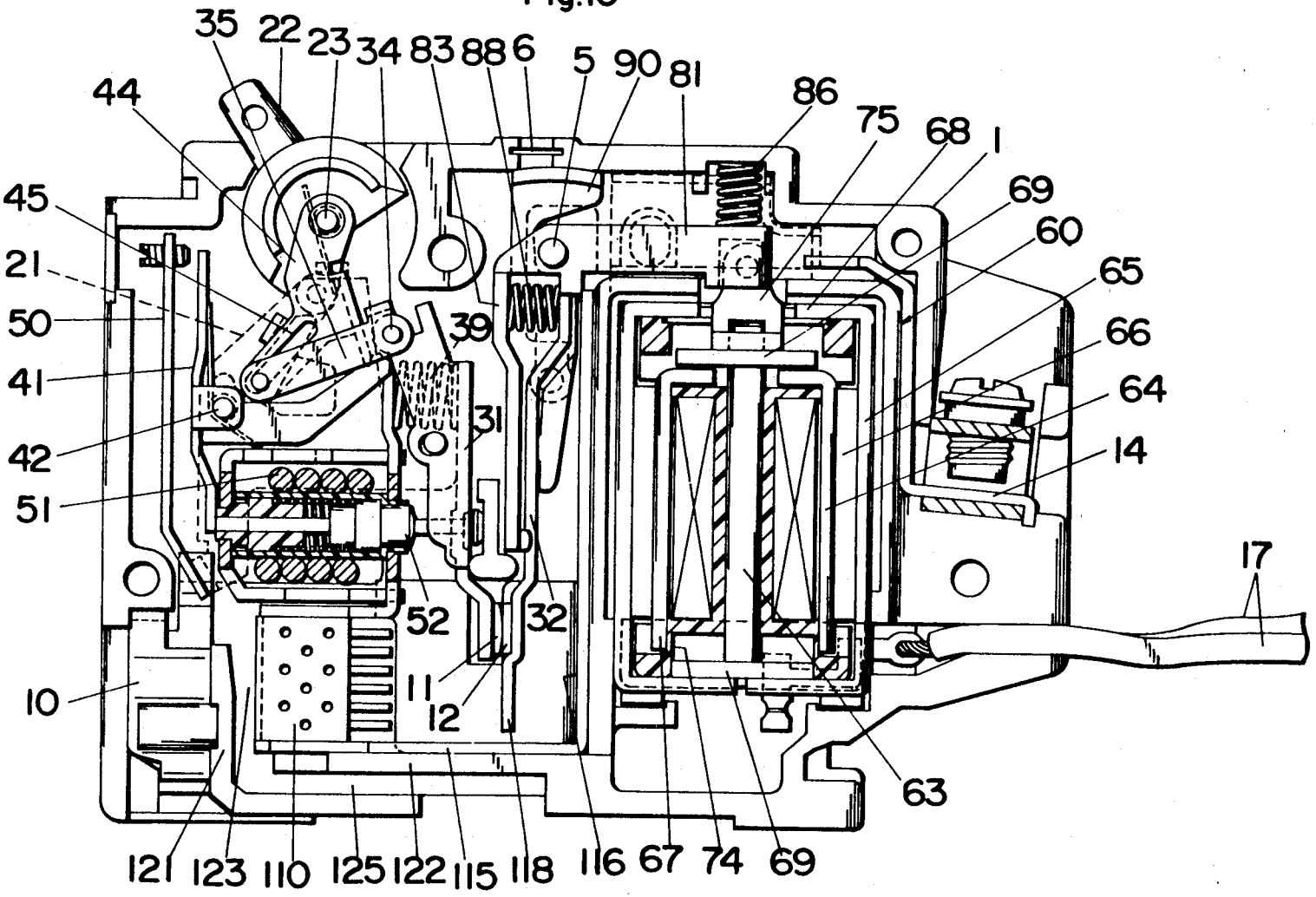
FIGS. 10 to 13 are respectively vertical sections illustrating various operating modes of the breaker.

Now referring to FIGS. 8 and 9, the electromagnet switch 60 will be discussed with its characterizing feature for improved response sensitivity to the control signal or reliable plunger movement upon the energization of the excitation coil 61. The electromagnet is characterized in that the inner pole end 67 at the lower end of each inner yoke 64 extends straight to define thereat a pole tip that is laterally spaced from the vertical plane in which the lateral edge of the adjacent pole plate 69 travels as the plunger core 63 moves axially in response to the energization and deenergization of the excitation coil 61. With this result, the pole tip 67 is permitted to extend over the lateral side of the adjacent pole plate 69 in its attracted position to the inner yokes 64 [FIG. 9] in order to reduce the gap or magnetic resistance between the pole tip 67 and the adjacent pole plate 69 in its attracted position to the outer yokes 65 [FIG. 10] while retaining a desired plunger stroke and without interference with the movement of the pole plate 69. Consequently, when the excitation coil 61 is energized to produce in the magnetic circuit a magnetic flux $\phi_1$ opposing the magnetic flux $\phi_2$ by the permanent magnet 66, the magnetic flux $\phi_1$ will pass through thus reduced gap X, or reduced magnetic resistance between the pole tip 67 and the adjacent pole plate 69, thereby increasing a magnetic attraction force acting on the plunger core 63 to move it axially upwardly to the position of FIG. 9 from the position of FIG. 10. In other words, the plunger core 63 can have an improved response sensitivity to the energization of the excitation coil 61, or the remote control signal.

For achieving a smooth movement of the pole plate 69 in relation to the pole tips 67 of the inner yokes 64, the coil bobbin 62 is formed with a thin-walled guide segment 74 extending integrally from the lower flanged portion thereof into the clearance between the pole tip 67 and the lateral face of the adjacent pole plate 69. The guide segment 74 defines on its inner surface a smoothly finished guide surface along which the lateral edge of the adjacent pole plate 69 will be guided as the plunger core 62 is driven to move axially.

Figure 20:
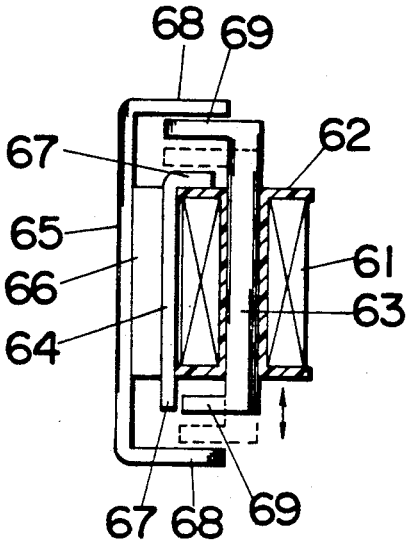
FIGS. 20 to 22 are respectively schematic views showing modified structures of the electromagnet.

Although the electromagnet 60 in the present invention is configured to be symmetrical with respect to the axis of the plunger core 63, it is equally possible to arrange an inner yoke 64, an outer yoke 65, a permanent magnet 66, and pole plates 69 on the one lateral side of the plunger core 63, as shown in FIG. 20.

Figure 21:
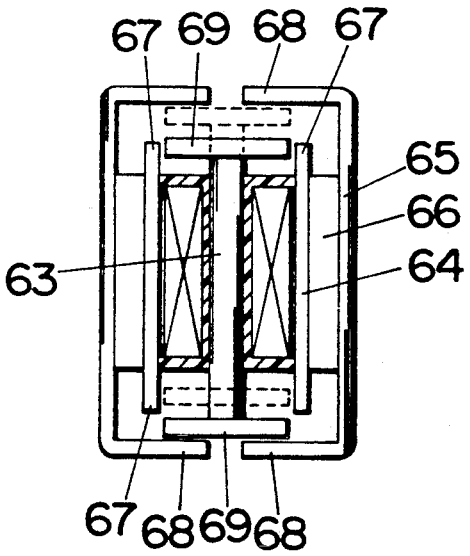
Figure 22:
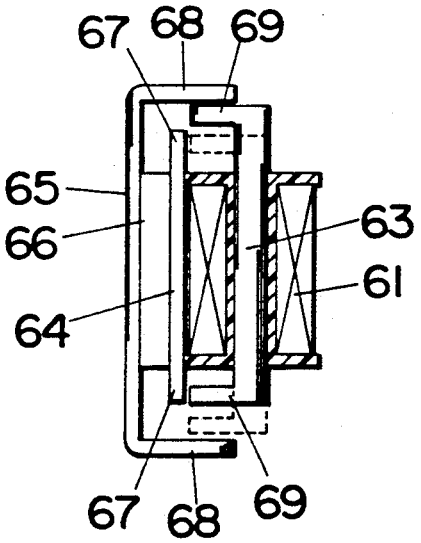

Further, the breaker of the present invention may utilize as a remote control switch means an electromagnet of bistable type, as shown in FIGS. 21 and 22, which holds the second contact at either of the inoperative and operative positions and switches the positions by receiving control signal of opposite polarities. In these modifications of FIGS. 21 and 22, the same scheme is applied to increase response sensitivity of the plunger core 63B, 63C to the energization of the excitation coil 61B, 61C by adopting the like arrangement that the inner yoke 64B, 64C has its pole ends, or pole tips 67B, 67C offset laterally outwardly of the adjacent pole plate 69B, 69C to permit the inner pole ends to extend over the lateral side of the pole plates 69B, 69C in their attracted position to the inner pole ends 67B, 67C.

Mounted in the bottom of the breaker housing 1 is an arc extinction assembly which comprises an arc chute 110, an arc runner 115 extending along the inner bottom of the housing 1 in the contact separating direction and terminating in the bottom of the arc chute 110, and the arc drive member 116 extending vertically along the partition 4 and connected at its lower end to the arc runner 115. The arc runner 115 is integrally formed with the arc drive member 116 and is electrically connected therethrough to the second contact arm 32 at 117. Once an arc is developed between the separating contacts 11 and 12 as seen in a rapid contact separation due to the overcurrent condition, one end of the arc is shifted from the second contact 12 onto the immediately adjacent portion of the arc runner 115 while the other end of the arc is on the first contact 11. As the first contact 11 travels along a path to its OFF position, the arc proceeds With the one end thereof anchored on the arc runner 115 into the arc chute 110 where it comes into contact with a stack of spaced arc shearing plates 112 to be extinguished thereat. The stack of the arc shearing plates 112 is supported by a holder 113 and disposed between the ends of the arc runner 115 and a horizontal plate 25 on the frame 21 of the switching mechanism 20.

When the arc is shifted to extend between the first contact 11 and the arc runner 115, the arc current will flow through a U-shaped path composed of the first contact arm 31, the arcing gap, the portion of the arc runner 115 and the arc drive member 116 extending generally in parallel relation to the first contact arm 31. Whereby electromagnetic repulsion forces are produced between the parallel conducting limbs of the U-shaped path and are concentrated on the arc to urge or drive it towards the arc chute 110 for rapid extinction Of the arc. It is noted at this time that the arc drive member 116 constitutes the U-shaped arc current path instead of the second contact arm 32 upon the occurrence of the arc, keeping the second contact arm 32 free from the arc current and protecting the second contact 12 from being damaged by the arc. This is particularly advantageous in that the second contact arm 32 can be selected solely in view of its conductivity and without regard to arc resistivity, and that the arc drive member 116 and the arc runner 115 can be selected mainly in view of its arc resistivity. To this end, the second contact arm 32 is made from a copper or its alloy having a superior conductivity while the arc runner 115 and the arc drive member 116 are made of an iron or ferro alloy having good heat resistivity but relatively great electric resistance. With the use of such material having relatively great electric resistance for the arc runner 115 and arc drive member 116, a considerable current limiting effect can be obtained upon the arc current flowing therethrough, thereby contributing to the extinction of the arc.

Figure 15:
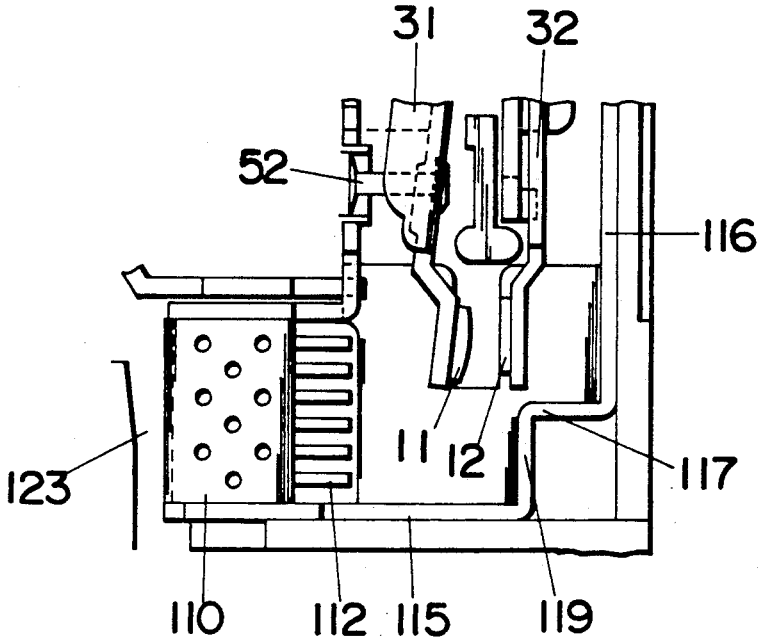
FIG. 15 is a partial front view illustrating an arc driving arrangement in a modification of the above embodiment.

For enhancing to shift the one end of the arc to the arc runner 115, a pilot extension 118 extends from the lower end of the second contact arm 32 in close proximity to the arc runner 115. For the same purpose, the connection between the arc runner 115 and the arc drive member 116 may be bent toward the lower end of the second contact arm 32, as seen in FIG. 15, a modification of the present embodiment. In this modification, a vertical segment 119 is formed in the connection between the arc runner 115 and the arc drive member 116 to extend in a position closer to the first contact arm 31 than the substantial portion of the arc drive member 116. Thus, the vertical segment 119 acts to exert the electromagnetic force for urging the arc towards the arc chute 110, in addition to that it serves as a barrier for blowing back an arc gas towards the arc chute 110.

Figure 14:
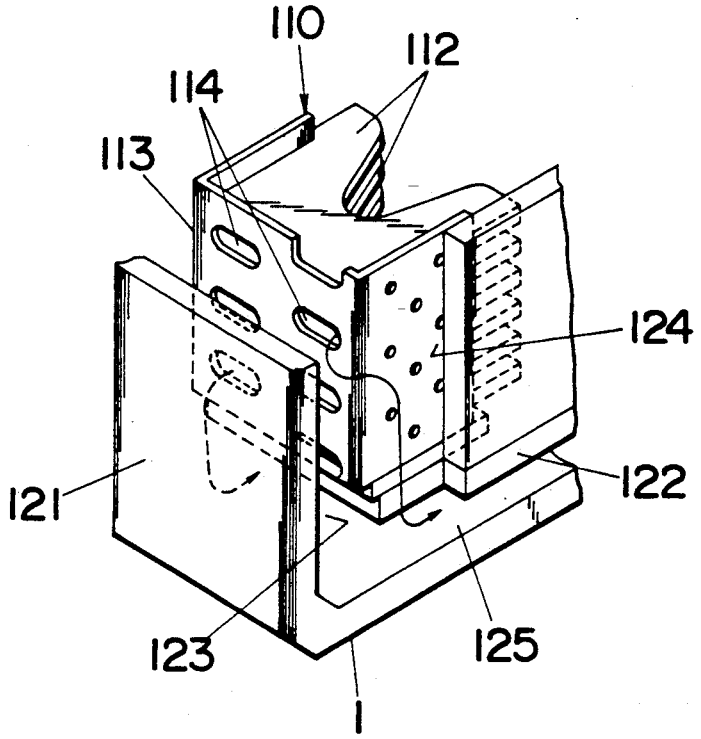
FIG. 14 is a partial perspective view of an arc extinguishing chute and its associated portion of the breaker housing.

For receiving the arc chute 110, there is formed in the lower portion of the housing 1 a chamber 120 which opens in the direction of the first and second contacts 11 and 12 and which is confined at its rear by a vertical rib 121, at its bottom by a horizontal rib 122, and at its opposite sides respectively by the housing 1 and the side cover 3. These ribs 121 and 122 are integral With the housing 1. The arc chute 110 is disposed in the chamber 120 with the rear wall of the holder 113 in spaced relation to the vertical rib 121 so as to form therebetween a space 123. As shown in FIG. 14, it is through this space 13 that escape ports 114 in the rear wall of the holder 113 communicate With an exhaust port 125 formed in the bottom wall of the housing 1 downwardly of the horizontal rib 122 for exhausting a volume of ionized gases produced by the arc reacting with its environments including the arc shearing plates 112. As seen in the figure, the side wall or the side cover 3 is notched to form on the rear portion of the side face of the arc chute 110 an additional space 124 which communicates rearwardly with the space 123 and downwardly with the exhaust port 125. Thus, the arc gas rushing out through the escape ports 114 can be routed through the spaces 124 and 125 along several flow courses as indicated by arrows in the figure toward the exhaust port 125 to be finally discharged outwardly of the housing 1. It is noted at this point that the vertical section of the partition 4 surrounding the electromagnet switch 60 acts as a barrier preventing the entry of the arc gas into the electromagnet 60 as well as to blow back the arc gas toward the arc chute 110 for expelling it through the escape ports 114.

Figure 16:
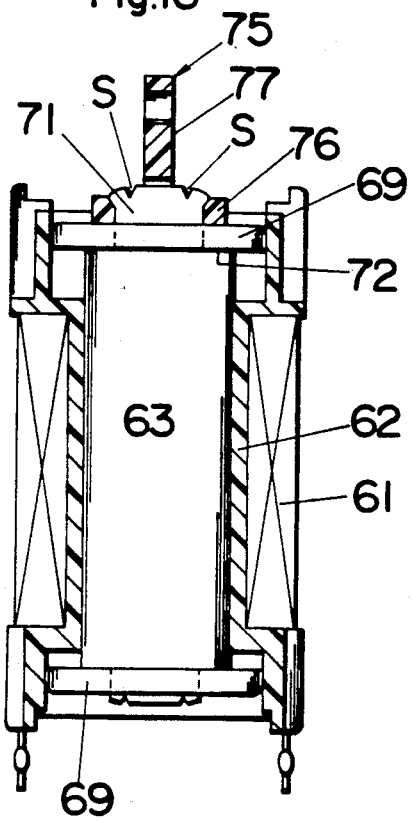
FIG. 16 is a front view illustrating the rigid connection between the plunger of the electromagnet and a joint for the second contact of the breaker.
Figure 17:
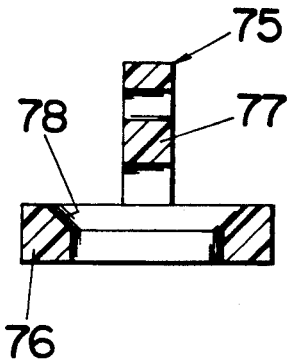
FIG. 17 is a sectional view of the joint utilized in FIG. 16.

FIG. 16 shows the connection of the plunger core 63 of the electromagnet 60 and the joint 75 utilized to couple the plunger core 63 to the horizontal member 81 of the L-shaped actuator 80. The joint 75 is made of a plastic material and comprises a square ring 76 and a tab 77 extending from the opposite sides of the ring 76, as shown in FIGS. 4 and 16, for pivotal connection by the pin 82 to the actuator 80. The ring 76 fits around a center stud 71 projecting from the upper end of the plunger core 63 with the upper pole plate held between the ring 76 and a shouldered stop 72 on the upper end of the plunger core 63. After placing the ring 76 in position, the upper end of the stud 71 is struck at spaced points S by a suitable jig so as to partially deform the portion outwardly of the points S into engagement with a bevelled brim 78 formed around the inner periphery of the ring 76, thus rigidly connecting the joint 75 to the upper end of the plunger core 63 at the same time of connecting the pole plate 69 thereto.

Figure 18:
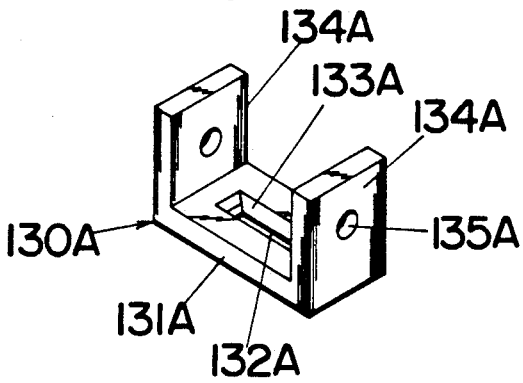
FIGS. 18 and 19 are respectively perspective views showing modifications of the joint utilized in FIG. 16.
Figure 19:
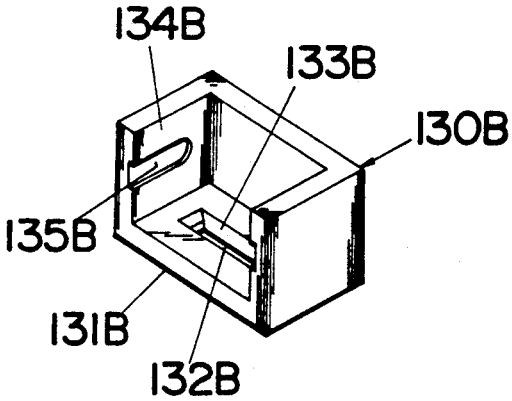

As shown in FIGS. 18 and 19, other types of joints 130A and 130B may be utilized instead of the joint 75. Each of the joint 130A and 130B comprises a base 131A, 131B with a pair of upward tabs 134A, 134B on the opposite sides thereof. The base 131A, 131B has in its center an aperture 132A, 132B with a beveled brim 133A, 133B around the upper edge thereof so that the upper end of the like plunger core extending through the aperture 132A, 132B can be partially deformed for engagement with the bevelled brim 133A, 133B in the like manner as described in the above. The tabs 134A and 134B are formed respectively with bearing holes 135A and bearing groove 135B for pivotal connection to the horizontal member of the L-shaped actuator by means of a pin.

What is claimed is:

1. A remotely controllable circuit breaker comprising:

a housing;

a breaker contact comprising first and second movable contacts;

a first contact arm carrying at its one end said first movable contact and movable between an OFF position and an ON position;

a second contact arm extending generally in parallel relation to said first contact arm and formed with said second movable contact on the same end as said first contact arm;

a switching mechanism for opening and closing said breaker contact, said switching mechanism including a manual handle connected to move said first contact arm between the OFF position and the ON position, said switching mechanism further including trip means acting to forcibly move said first contact arm toward its OFF position from its ON position in response to an overcurrent flowing through the circuit of the breaker;

a remotely controllable switch operatively connected to a remote control signal, the second contact arm between an operative position where said second contact is permitted to come into contact with said first contact in said ON position and an inoperative position where said second contact is kept away from said first contact to be inhibited from contacting therewith;

an arc extinguishing chute disposed on the opposite side of said first contact arm from said second contact arm for extinguishing an arc initially developed between the rapidly separating first and second contacts;

an arc runner electrically coupled to the second contact arm and extending generally along the opening path of said first contact and leading to said arc extinguishing chute for receiving from said second contact the one end of said arc and guiding the arc toward said arc extinguishing chute with said one end of the arc anchored on the surface of the arc runner as the first contact moves to its OFF position; and an arc drive member extending immediately behind said second contact arm, said second contact arm connected to said remotely controllable switch in such a way as to leave no substantial part between said second contact arm and said arc drive member, and said arc drive member extending in generally parallel relation to said first contact arm with its one end connected to said arc runner, the other end of said arc drive member electrically connected to the end of the second contact arm opposite to said second contact such that the arc drive member and said arc runner constitute a bypass for the arc current across said second contact arm, said arc drive member cooperative upon the occurrence of the arc with the first contact arm to develop in the region therebetween a magnetic field that extends transversely of said arc for producing an electromagnetic repulsion force which acts on the arc to urge it towards said arc extinguishing chute.

2. A remotely controllable circuit breaker as set forth in claim 1, wherein said second contact arm is made of a material having good electrical conductivity, while said arc runner and the arc drive members are made of a material which is different from that of said second contact arm and exhibits good heat resistivity.

3. A remotely controllable circuit breaker as set forth in claim 1, wherein said remotely controllable switch comprises an electromagnet which is disposed in said housing in side-by-side relation to said switching mechanism with said first and second contact arms interposed therebetween, and said arc drive member extends along a partition wall and is electrically isolated thereby from said electromagnet, said partition wall constituting a barrier for blowing back an arc gas produced by the arc towards said arc chute.

4. A remotely controllable circuit breaker as set forth in claim 1, wherein said second contact arm is formed at its end adjacent said second contact with a pilot extension which projects toward said arc runner to leave therebetween a small arc transferring gap.

5. A remotely controllable circuit breaker as set forth in claim 1, wherein the connection between said arc runner and said arc drive member is bent towards the end of said second contact arm carrying the second contact so as to leave between the bent portion and said end of the second contact arm a small arc transferring gap, said connection including a vertical segment which extends in a generally parallel relation to said first contact arm and in a position closer thereto than the substantial portion of said arc drive member.

6. A remotely controllable circuit breaker as set forth in claim 1, wherein said arc extinguishing chute comprises a number of stacked arc shearing plates supported by a holder and is provided in its rear wall of said holder opposite to the first contract arm with an escape opening for a volume of ionized gases developed by said arc reacting with its environments, said chute disposed within a chamber in said breaker housing with the rear wall of the chute in spaced relation from the corresponding rear wall of said chamber to leave therebetween a rear space through which said escape port opening communicates with an exhaust port formed in the bottom wall of said chamber and leading to the exterior of said breaker housing, said chamber formed in its side walls at a portion adjacent the rear wall with a notched space which communicates with said rear space as well as said exhaust port.

7. A remotely controllable circuit breaker comprising:

a housing;

a breaker contact comprising first and second movable contacts;

a first contact arm carrying at its one end said first movable contact and movable between an OFF position and an ON position;

a second contact arm extending generally in parallel relation to said first contact arm and formed with said second movable contact on the same end as said first contact arm;

a switching mechanism for opening and closing said breaker contact, said switching mechanism including a manual handle connected to move said first contact arm between the OFF position and the ON position, said switching mechanism further including trip means acting to forcibly move said first contact arm toward its OFF position from its ON position in response to an overcurrent flowing through the circuit of the breaker;

a remotely controllable electromagnet switch operatively connected to said second contact arm to move, in response to a remote control signal, the second contact arm between an operative position where said second contact is permitted to come into contact with said first contact in said ON position and an inoperative position where said second contact is kept away from said first contact to be inhibited from contacting therewith;

an arc extinguishing chute disposed on the opposite side of said first contact arm from said second contact arm for extinguishing an arc initially developed between the rapidly separating first and second contacts;

an arc runner electrically coupled to the second contact arm and extending generally along the opening path of said first contact and leading to said arc extinguishing chute for receiving from said second contact the one end of said arc and guiding the arc toward said arc extinguishing chute with said one end of the arc anchored on the surface of the arc runner as the first contact moves to its OFF position;

an arc drive member extending immediately behind said second contact arm without leaving any substantial part therebetween and in generally parallel relation to said first contact arm with its one end connected to said arc runner, the other end of said arc drive member electrically connected to the end of the second contact arm opposite to said second contact such that the arc drive member and said arc runner constitute a bypass for the arc current across said second contact arm, said arc drive member cooperative upon the occurrence of the arc with the first contact arm to develop in the region therebetween a magnetic field that extends transversely of said arc for producing an electromagnetic repulsion force which acts on the arc to urge it towards said arc extinguishing chute;

said remotely controllable electromagnet switch disposed in said housing in side-by-side relation to said switching mechanism with said first and second contact arms interposed therebetween;

said arc drive member extending along a partition wall and electrically isolated thereby from said remote controllable electromagnet switch, said partition wall serving as a barrier for blowing an arc gases resulting from the arc towards said arc chute;

said second contact arm formed at its end adjacent said second contact with a pilot extension which projects toward said arc runner to leave therebetween a small arc transferring gap;

said arc extinguishing chute comprising a number of stacked arc shearing plates supported by a holder and provided in its rear wall of said holder opposite to the first contract arm with an escape opening for a volume of ionized gases developed by said arc reacting with its environments;

said chute disposed within a chamber in said breaker housing with the rear wall of the chute in spaced relation from the corresponding rear wall of said chamber to leave therebetween a rear space through which said escape port opening communicates with an exhaust port formed in the bottom wall of said chamber and leading to the exterior of said breaker housing;

said chamber formed in its side walls at a portion adjacent the rear wall with a notched space which communicates with said rear space as well as with said exhaust port.

* * * * *